US007509762B2

(12) United States Patent
Ajumobi

(10) Patent No.: US 7,509,762 B2
(45) Date of Patent: Mar. 31, 2009

(54) MULTI-SIDED DISPLAY SIGN APPARATUS

(76) Inventor: Ayorinde Ajumobi, 17 rue Bethisy, 93130 Noisy le Sec (FR)

( * ) Notice: Subject to any disclaimer, the term of this patent is extended or adjusted under 35 U.S.C. 154(b) by 41 days.

(21) Appl. No.: 11/429,534

(22) Filed: May 5, 2006

(65) Prior Publication Data

US 2006/0260159 A1 Nov. 23, 2006

Related U.S. Application Data

(60) Provisional application No. 60/679,389, filed on May 10, 2005.

(51) Int. Cl.
*G09F 11/02* (2006.01)

(52) U.S. Cl. ..... 40/503; 40/504

(58) Field of Classification Search ..... 40/503, 40/504, 505, 506, 507
See application file for complete search history.

(56) References Cited

U.S. PATENT DOCUMENTS

| | | | | |
|---|---|---|---|---|
| 1,058,698 | A * | 4/1913 | Goldstein | 40/505 |
| 1,717,077 | A * | 6/1929 | Von Marbod | 40/504 |
| 2,731,745 | A * | 1/1956 | O'Neill | 40/463 |
| 5,003,716 | A * | 4/1991 | Dyar | 40/503 |
| 5,225,465 | A | 7/1993 | Eichenauer et al. | |
| 5,315,776 | A | 5/1994 | Strawbridge et al. | |
| 5,528,258 | A * | 6/1996 | Moon | 345/110 |
| 5,696,494 | A * | 12/1997 | Chen | 340/815.4 |
| 5,806,221 | A | 9/1998 | Vander Woude | |
| 6,216,371 | B1 * | 4/2001 | Kim | 40/503 |
| 6,234,034 | B1 * | 5/2001 | Ando | 74/89.14 |
| 2002/0095836 | A1 * | 7/2002 | Segan et al. | 40/503 |

* cited by examiner

*Primary Examiner*—Gary C Hoge
(74) *Attorney, Agent, or Firm*—James Ray & Assoc.

(57) ABSTRACT

A display sign apparatus includes a stationary frame and a movable frame mounted therein for reciprocal lateral movement. One drive system is provided for moving the movable frame. Each of the stationary and movable frames has a plurality of elongated display sign elements mounted in a spaced relationship. Another drive system is provided for rotating each element about its longitudinal axis. The elongated display sign elements are movable between a first position wherein the elements are interposed with a side-by-side arrangement and a second position wherein the elements in the movable frame are laterally spaced from the elements mounted on the stationary frame.

15 Claims, 3 Drawing Sheets

MULTI-SIDED DISPLAY SIGN APPARATUS

CROSS-REFERENCE TO RELATED APPLICATIONS

This application is related to and claims priory from Provisional Patent Application Ser. No. 60/679,389 filed May 10, 2005.

FIELD OF THE INVENTION

The present invention relates, in general, to display signs and, more particularly, this invention relates to non-electronic display signs that employ a plurality of rotating panels for displaying a plurality of distinct advertisements.

BACKGROUND OF THE INVENTION

As is generally well known, non-electronic display signs include a plurality of panels arranged in a side-by-side arrangement with each panel having a portion of a pictorial or informational scene. One type of such display sign, currently widely in use, includes triangular shaped panels which form three different scenes. The panels are rotated in unison to display a complete pictorial or informational scene.

Such display signs are disclosed in U.S. Pat. No. 5,806,221 to Woude; in U.S. Pat. No. 5,315,776 to Strawbridge et al; and in U.S. Pat. No. 5,225,465 to Perez. However, the disadvantages of such triangular panels are related to only one scene being displayed at any given time and are further related to a limit of only three distinct scenes.

SUMMARY OF THE INVENTION

The present invention provides a multi-sided display sign apparatus. The apparatus includes a stationary frame and a first plurality of elongated display sign elements mounted in a spaced relationship within the stationary frame. A mounting means is provided for mounting each of the first plurality of elongated display sign elements for rotation about a longitudinal axis thereof. A drive means is provided for rotating the first plurality of elongated display sign elements. There is also a movable frame and a second plurality of elongated display sign elements mounted in a spaced relationship within the movable frame. A mounting means is provided for mounting each of the second plurality of elongated display sign elements for rotation about a longitudinal axis thereof. A drive means is provided for rotating the second plurality of elongated display sign elements. Additionally, there is a means attached to the stationary frame and connected to the movable frame for laterally moving the movable frame and the second plurality of elongated display sign elements between a first position wherein the second plurality of elongated display sign elements are interposed with the first plurality of elongated display sign elements in a side-by-side arrangement and a second position wherein the second plurality of elongated display sign elements are laterally spaced from the first plurality of elongated display sign elements.

OBJECTS OF THE INVENTION

It is, therefore, one of the primary objects of the present invention to provide a multi-sided display apparatus.

Another object of the present invention is to provide a multi-sided display apparatus which is capable of displaying four different pictorial or informational scenes.

Yet another object of the present invention is to provide a multi-sided display apparatus which is capable of simultaneously displaying two pictorial or informational scenes.

A further object of the present invention is to provide a multi-sided display apparatus usable in an outdoor environment.

Yet a further object of the present invention is to provide a multi-sided display apparatus which employs electric drives.

An additional object of the present invention is to provide a multi-sided display apparatus that is simple to use.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
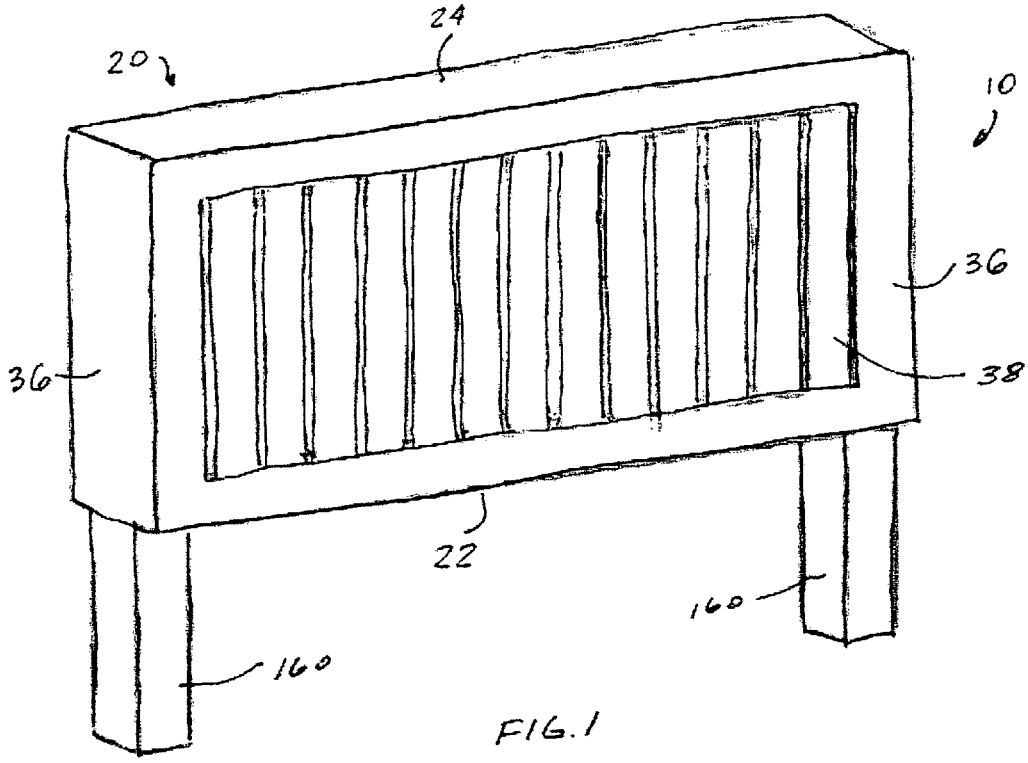
FIG. 1 is a perspective view of a multi-sided display sign apparatus of the present invention.

Prior to proceeding to the more detailed description of the present invention, it should be noted that, for the sake of clarity and understanding, identical components which have identical functions have been identified with identical reference numerals throughout the several views illustrated in the drawing figures.

Reference is now made, to FIGS. 1-7. Illustrated therein is one embodiment of a multi-sided display sign apparatus, generally designated 10, which includes a stationary frame, generally designated 20. The stationary frame 20 includes a bottom U-shaped panel 22, a top U-shaped panel 24 and a pair of U-shaped side panels 36 forming a pair of apertures 38. Each of the bottom panel 22 and top panel 24 has a horizontal flange 26, which is formed inwardly and which employs a plurality of equally spaced notches 28. A plurality of apertures 30 are equally spaced and formed in the flange portions 32 which are interposed with notches 28. In such arrangement, the notches 28 and apertures 30 in the flange 26 of the bottom panel 22 are aligned with the notches 28 and apertures 30 in the flange 26 of the top panel 24.

There is a first plurality of elongated display sign elements 40 each having a predetermined shape and mounted in a vertical position and in a spaced relationship within the stationary frame 20. For the sake of clarity, each of such first plurality of elongated display sign elements is referenced with numeral 40*a*. A first means, generally designated 50, is provided for mounting each of the first plurality of elongated display sign elements 40*a* for rotation about a longitudinal axis 41 thereof.

Figure 4:
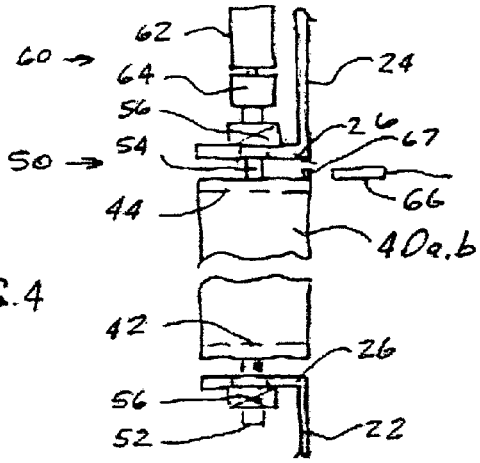
FIG. 4 is a partial side elevation view of the multi-sided display sign apparatus of FIG. 1 showing a drive system for rotating each sign element of the presently preferred embodiment.

Now in reference to FIG. 4, such first mounting means 50 includes a first shaft portion 52 attached to and extending axially and outwardly from a first end member 42 of the elongated display sign element 40*a* and a second shaft portion 54 attached to and extending axially and outwardly from an opposed second end member 44 of the elongated display sign element 40*a*. The first shaft portion 52 and the second shaft portion 54 rotateably communicate with an aperture 32 of the respective flange 26. To aid in rotation of the elongated display sign element 40*a*, the first mounting means 50 may further include a pair of bearings 56 each rigidly secured to a respective flange 26 and aligned with respective first shaft portion 52 and the second shaft portion 54.

The apparatus 10 is further provided with a first drive means, generally designated 60, for rotating the first plurality of elongated display sign elements 40*a*. In the presently preferred embodiment of the invention, the first drive means 60 includes a plurality of electric stepper motors 62 each axially connected to one of the first shaft portion 52 and the second shaft portion 54 of a respective one of the first plurality of elongated display sign elements 40*a*. Such plurality of electric stepper motors 62 are selectively operable to rotate the first plurality of elongated display sign elements 40*a* in a ninety degree increment. The first drive means 60 may further include a plurality of frictional clutch means 64 each attached intermediate a respective one of the plurality of stepper motors 62 and the first plurality of elongated display sign elements 40*a*.

There is a sensing means 66 and a predetermined plurality of targets 67 provided for sensing incremental rotation of at least one of the first plurality of elongated display sign elements 40*a*. It will be appreciated that employment of a plurality of electric stepper motors 62 will be advantageous in rotating only a predetermined portion of such first plurality of elongated display sign elements 40*a* or rotating them in a sequential fashion.

Alternatively, the first drive means 60 may include an electric drive 70 stationaryly mounted on the fixed frame 20 and a power transmission means 74 connected to an output shaft 72 of the electric drive 70 and to each of the first plurality of elongated display elements 40*a*. The power transmission means 74 includes but is not limited to one of a gear, belt, chain, cable, lever and various combinations thereof. By way of example in FIG. 5, such power transmission means 74 is schematically illustrated as a belt 76, a driving pulley 77 attached to the output shaft 72, and a plurality of pulleys 78 each attached to one of the first shaft portion 52 and second shaft portion 54 connected to the respective elongated display sign element 40*a*.

U.S. Pat. No. 5,225,465 to Perez and U.S. Pat. No. 5,806,221 to Vander Woude disclose power transmission means 74 which employ linkage and gear arrangements. The teachings of U.S. Pat. No. 5,225,465 and U.S. Pat. No. 5,806,221 are incorporated into this document by reference thereto.

A movable frame, generally designated 80, is mounted for linear reciprocal movement within stationary frame 20. Movable frame 80 has at least an upper member 81 and a lower member 82 each formed by a plurality of U-shaped sections 84 connected therebetween with a plurality of flange members 88. The U-shaped sections 84 of the upper member 81 are oppositely disposed to the U-shaped sections 84 of the lower member 82. Furthermore, the flanges 85 of each U-shaped section 84 of upper member 81 extend in a vertical direction towards the top panel 24 of the stationary frame 20 and flanges 85 of each U-shaped section 84 of the lower member 82 extend in a vertical direction towards the bottom panel 22 of the stationary frame 20. A generally horizontal base 86 of each U-shaped section 84 is adapted with an aperture 89.

The movable frame 80 is provided for rotateably supporting a second plurality of elongated display sign elements 40*a* mounted in a spaced relationship within the movable frame 80. For the sake of clarity, each of such second plurality of elongated display sign elements is referenced as 40*b*. A second mounting means 90 which is identical to first mounting means 50 is provided for mounting each of the second plurality of elongated display sign elements 40*b* for rotation about a longitudinal axis 41 thereof. A second drive means 100 is provided for rotating the second plurality of elongated display sign elements 40*b*.

Preferably, each of the first plurality of elongated display sign elements 40*a* and the second plurality of elongated display sign elements 40*b* is formed as a hollow right prism having a square cross-section. Such elongated display sign element 40 may be made from any material suitable to withstand the outdoor weather elements. Materials such as aluminum and plastic are further advantageous for reducing the overall weight of the apparatus 10. In such arrangement, the elongated display sign element 40 is capable of carrying four different scene portions.

In the presently preferred embodiment of the invention the second drive means 100 is substantially identical to the first drive means 60 and preferably includes a plurality of electric stepper motors 62 each axially connected to an opposed one of the first shaft portion 52 and the second shaft portion 54 of a respective one of the second plurality of elongated display sign elements 40*b*.

Figure 2A:
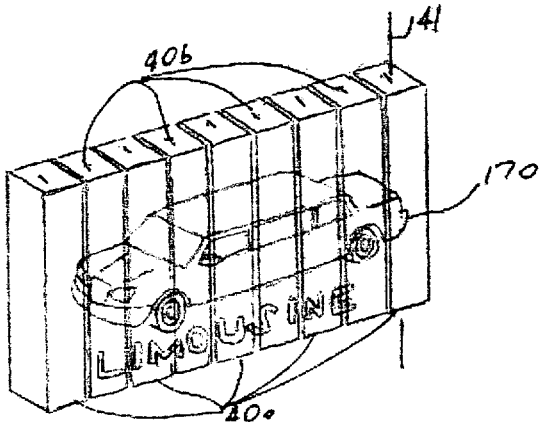
FIG. 2*a* is a schematic representation of the multi-sided display sign apparatus of FIG. 1 showing a plurality of sign elements disposed in a first position for a side-by-side arrangement.
Figure 2B:
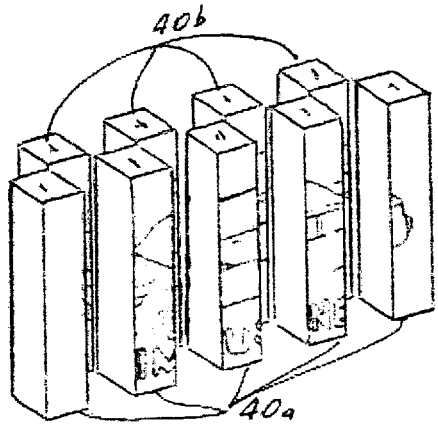
FIG. 2*b* is a schematic representation of the multi-sided display sign apparatus of FIG. 1 showing a plurality of sign elements disposed in a second position for incrementally rotating each sign element.

For reasons to be explained further, the apparatus 10 includes a means, generally designated 120 attached to the stationary frame 20 and connected to the movable frame 80 for laterally moving the movable frame 80 and the second plurality of elongated display sign elements 40*b* between a first position, best shown in FIG. 2*a*, wherein the second plurality of elongated display sign elements 40*b* are interposed with the first plurality of elongated display sign elements 40*a* in a side-by-side arrangement and a second position, best shown in FIG. 2*b*, wherein the second plurality of elongated display sign elements 40*b* are laterally spaced from the first plurality of elongated display sign elements 40*a*.

In such side-by-side arrangement, the U-shaped sections 84 are aligned with notches 28 in flange 26 of the bottom panel 22 and the top panel 24. Accordingly, each base 86 of each U-shaped section 84 and each flange portion 32 in the flange 26 are disposed in a coplanar arrangement.

Figure 3:
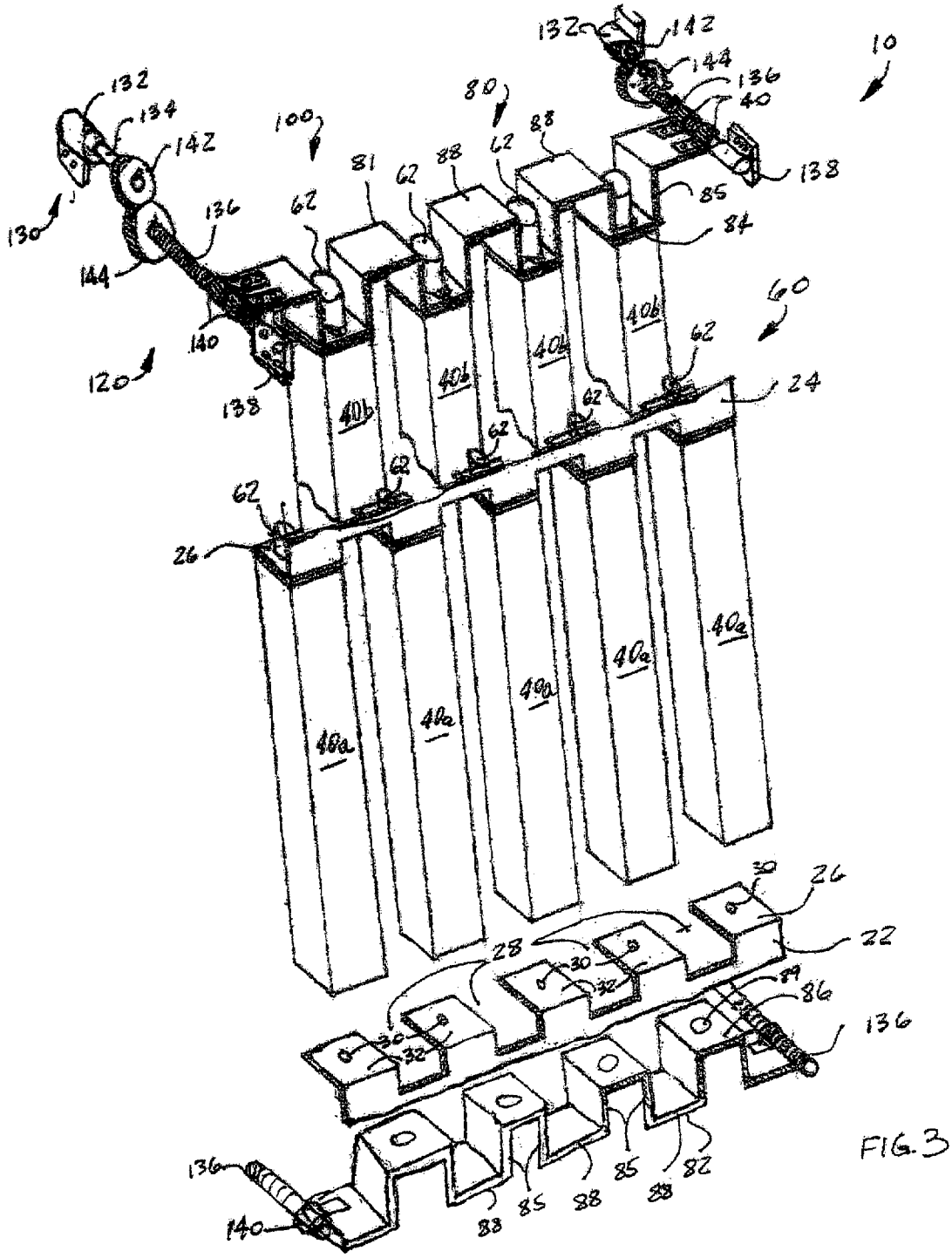
FIG. 3 is an exploded perspective view of the multi-sided display sign apparatus of FIG. 1 showing a system for rotating each sign element and for a reciprocally moving movable frame.

In further reference to FIG. 3, means 120 for moving the movable frame 80, of the presently preferred embodiment of the invention, includes a plurality of drive means, generally designated 130, each including an electric motor 132 rigidly attached to a predetermined portion of the stationary frame 20 and having a horizontally disposed output shaft 134, a drive screw 136 connected to the output shaft 134 and horizontally and rotateably mounted with a bearing mount 138 and at least one drive nut 140 connected to a predetermined portion of the movable frame 80 and mounted for reciprocal linear motion on the drive screw 136.

A pair of gears 142 and 144 may be coupled intermediate electric motor 130 and drive screw 136. The first gear 142 is attached to the output shaft 132 and the second gear 144 is attached to the drive screw 136. Preferably, each of the plurality of drive means 130 is mounted adjacent a respective corner of the movable frame 80.

Figure 6:
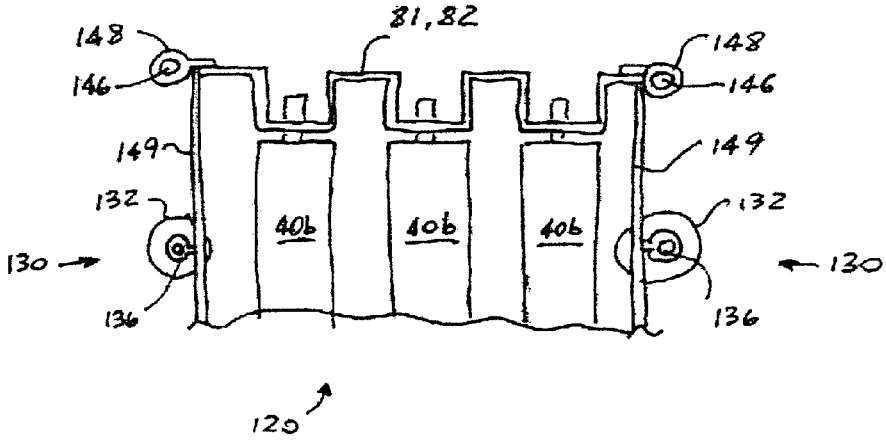
FIG. 6 is a partial schematic representation of an alternative drive system for reciprocally moving the movable frame.

Alternatively, as illustrated in FIG. 6, the means 120 for moving the movable frame 80 includes a pair of drive means 130 and a plurality of horizontally mounted guide means 146, such as rails, each having a connection 148 with the movable frame 80. Preferably, each guide rail 146 is mounted adjacent a respective corner of the movable frame 80. Each of the pair of drive means 130 may be connected to a respective vertical side member 149 of the movable frame 80.

Figure 7:
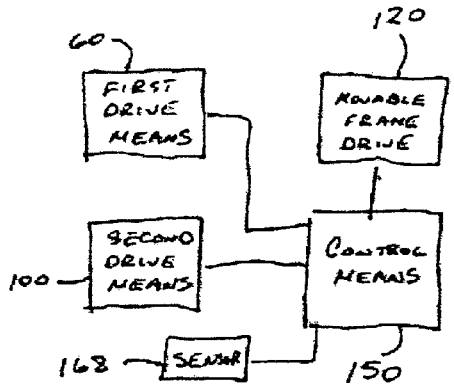
FIG. 7 is a schematic representation of the control system for operating the multi-sided display sign apparatus of FIG. 1.
Figure 5:
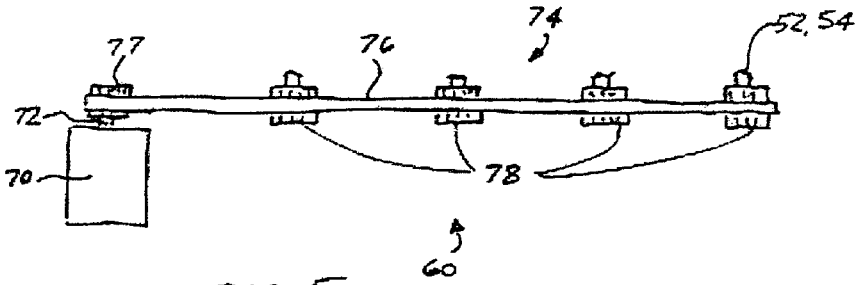
FIG. 5 is a partial schematic representation of an alternative drive system for rotating each sign element.

Each of the second drive means 100 and means 120 for moving the movable frame 80 may be provided with distinct control means, but preferably the apparatus 10 further includes a central control means 150, shown in FIG. 7, coupled to each of first drive means 60, second drive means 100 and means 120 for controlling rotation of the first and second plurality of elongated display sign elements 40 in ninety degree increments and for controlling lateral movement of the movable frame 80.

A pair of leg members 160 attached to the stationary frame 20 may be provided for mounting such apparatus 10 to a ground surface (not shown).

In use, each side panel of the elongated display sign element 40 has a portion of a different scene 170 disposed thereon such that when side panels representing a portion of a scene rotate into a coplanar relationship, such scene 170 is formed. Advantageously, the apparatus 10 will simultaneously display two distinct scenes 170. The use of a square prism construction enables the apparatus 10 to display four distinct scenes 170.

In order to form such scenes 170, the movable frame 80 is laterally moved by the means 120 from the first position into the second position so that each elongated display sign element 40 can rotate about its longitudinal axis 41. The first drive means 60 and the second drive means 100 are activated to respectively and, preferably, synchronously rotate the first and the second plurality of elongated display sign elements 40 in a ninety degree increment. Means 120 is then commanded to return movable frame 80 into the first position. After a predetermined time interval, movable frame 80 is moved again into the second position and the elongated display sign elements 40 are rotated by ninety degrees to form a different scene 170. Advantageously, the depth of the stationary frame 20 may be preselected to contain therein the second plurality of elongated display sign elements 40*b* being temporarily disposed in such second position.

It will be apparent to those skilled in the art, that the electric stepper motors 62 will be applicable to existing constructions of the multi-sided display signs which employ triangular shaped prisms.

Furthermore, the flanges 26 of the stationary frame 20 may be formed as independent members and attached to the bottom panel 22 and top panel 24.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

I claim:

1. A multi-sided display sign apparatus comprising:

(a) a stationary frame;

(b) a first plurality of elongated display sign elements mounted in a spaced relationship within said stationary frame;

(c) a first means for mounting each of said first plurality of elongated display sign elements for rotation about a longitudinal axis thereof;

(d) a first electrically operable drive means for rotating said first plurality of elongated display sign elements;

(e) a movable frame;

(f) a second plurality of elongated display sign elements mounted in a spaced relationship within said movable frame;

(g) a second means for mounting each of said second plurality of elongated display sign elements for rotation about a longitudinal axis thereof;

(h) a second electrically operable drive means for rotating said second plurality of elongated display sign elements; and (i) means disposed within and attached to said stationary frame and connected to said movable frame for laterally moving said movable frame and said second plurality of elongated display sign elements between a first position wherein said second plurality of elongated display sign elements are interposed with said first plurality of elongated display sign elements in a side-by-side arrangement and a second position wherein said second plurality of elongated display sign elements are laterally spaced from said first plurality of elongated display sign elements, said frame moving means including a quartet of drive assemblies each mounted adjacent a respective corner of each of said stationary and movable frames and having an electric motor rigidly attached to a predetermined portion of said stationary frame and having a horizontally disposed output shaft, a horizontally disposed drive screw connected to said output shaft of said electric motor, a bearing mount for rotateably mounting said drive screw, said bearing mount having a first flange extending outwardly therefrom and disposed in a vertical plane and at least a pair of apertures formed through said first flange, and a drive nut mounted for reciprocal linear motion on said drive screw, said drive nut having a second flange extending outwardly therefrom and disposed in a horizontal plane, said second flange directly connected to a predetermined portion of said movable frame.

2. The apparatus, according to claim 1, wherein each elongated display sign element is formed as a hollow right prism having a square cross-section.

3. The apparatus, according to claim 1, wherein each of said first and said second mounting means includes a first shaft portion extending axially and outwardly from a first end member of each elongated display sign element and a second shaft portion extending axially and outwardly from an opposed second end member of said each elongated display sign element.

4. The apparatus, according to claim 3, wherein said each of said first and said second mounting means further includes a pair of bearings rigidly secured to said stationary frame, each operatively engageable with a respective one of said first shaft portion and said second shaft portion.

5. The apparatus, according to claim 1, wherein said first electrically operable drive means includes a plurality of electric stepper motors each axially connected to a respective one of said first plurality of elongated display sign elements and a control means for selectively operating said plurality of electric stepper motors.

6. The apparatus, according to claim 5, wherein said first electrically operable drive means further includes a plurality of frictional clutch means each mounted intermediate a respective one of said plurality of stepper motors and said first plurality of elongated display sign elements.

7. The apparatus, according to claim 5, wherein said apparatus further includes a sensing means for sensing incremental rotation of at least one of said first plurality of elongated display sign elements and for providing a signal to said control means, said control means is at least responsive to said signal for controlling said first drive means to rotate said first plurality of elongated display sign elements in ninety degree increments.

8. The apparatus, according to claim 1, wherein said first electrically operable drive means includes an electric drive mounted in a stationary manner on said fixed frame and a power transmission means connected to an output shaft of said electric drive and connected to each of said first plurality of elongated display elements.

9. The apparatus, according to claim 8, wherein said power transmission means includes at least one of a gear, belt, chain, pulley, cable, lever and various combinations thereof.

10. The apparatus, according to claim 1, wherein said second electrically operable drive means includes a plurality of electric stepper motors each axially connected to a respective one of said second plurality of elongated display sign elements and a control means for selectively operating said plurality of electric stepper motors.

11. The apparatus, according to claim 1, wherein said means for moving said movable frame further includes a gear means coupled intermediate said electric motor and said drive screw.

12. The apparatus, according to claim 1, wherein said apparatus further includes a control means coupled to each of said first drive means, said second drive means and said means for moving said movable frame, said control means controlling rotation of said first plurality of elongated display sign elements and said second plurality of elongated display sign elements in ninety degree increments and controlling lateral movement of said movable frame.

13. The apparatus, according to claim 12, wherein said control means enables sequential rotation of at least a portion of said first plurality of elongated display sign elements and said second plurality of elongated display sign elements when said second plurality of elongated display sign elements are disposed in said second position.

14. A multi-sided display sign apparatus comprising:

(a) a stationary frame including:

(i) a bottom U-shaped member, (ii) a top U-shaped member, (iii) a pair of U-shaped side members, (iv) a first flange extending inwardly and horizontally from a front vertical leg of said bottom U-shaped member, (v) a predetermined plurality of first apertures formed through said first flange of said U-shaped bottom member in spaced relationship with each other, (vi) a predetermined plurality of first notches formed through said first flange of said U-shaped bottom member, each of said predetermined plurality of notches disposed between a pair of adjacent first apertures, (vi) a second flange extending inwardly and horizontally from a front vertical leg of said top U-shaped member, said second flange of said top member disposed parallel with said first flange of said bottom member, (vii) a predetermined plurality of second apertures formed through said second flange in spaced relationship with each other and in vertical alignment with predetermined plurality of first apertures, and (viii) a predetermined plurality of second notches formed through said second flange, each of said predetermined plurality of second notches disposed between a pair of adjacent second apertures in vertical alignment with a respective first notch of said bottom member;

(b) a first plurality of elongated display sign elements mounted in a spaced relationship within said stationary frame, wherein a longitudinal axis of each of said first plurality of elongated display sign elements is aligned with a respective first and second apertures;

(c) a first means for mounting each of said first plurality of elongated display sign elements for rotation about said longitudinal axis thereof;

(d) a first electrically operable drive means for rotating said first plurality of elongated display sign elements;

(e) a movable frame disposed internal add movable within said stationary frame, said movable frame including:

(i) a lower member having a predetermined plurality of first U-shaped sections, each of said predetermined plurality of first U-shaped sections extending in an upward direction and received within a respective first notch of said bottom member of said stationary frame;

(ii) an upper member having a predetermined plurality of second U-shaped sections extending in a downward direction, each of said predetermined plurality of second U-shaped is vertically aligned with a respective one of said predetermined plurality of first U-shaped sections and with a respective second notch of said top member of said stationary frame, (iii) a predetermined plurality of third apertures, each of said predetermined plurality of third apertures formed through a horizontally disposed portion of a respective first U-shaped section, and (iv) a predetermined plurality of forth apertures, each of said predetermined plurality of forth apertures formed through a horizontal portion of a respective second U-shaped section in vertical alignment with a respective third aperture;

(f) a second plurality of elongated display sign elements mounted in a spaced relationship within said movable frame, wherein a longitudinal axis of each of said second plurality of elongated display sign elements is vertically aligned with a respective third and forth apertures;

(g) a second means for mounting each of said second plurality of elongated display sign elements for rotation about a longitudinal axis thereof;

(h) a second electrically operable drive means for rotating said second plurality of elongated display sign elements; and (i) a quartet of drive assemblies, each of said quartet of drive assemblies positioned adjacent a respective corner of each of said stationary and movable frames and including:

(i) an electric motor having each of a first vertically disposed flange extending outwardly thereof for rigid attachment to a predetermined portion of said stationary frame and a horizontally disposed output shaft, (ii) a horizontally disposed drive screw connected at one end thereof to said output shaft of said electric motor, (iii) a bearing mount for rotateably mounting an opposed end of said drive screw, said bearing mount having a second vertically disposed flange extending outwardly thereof and at least a pair of apertures formed through said vertically disposed flange, (iv) at least one drive nut mounted for reciprocal linear motion on said drive screw, said at least one drive nut having a horizontally disposed flange extending therefrom, said horizontally disposed flange directly attached to a horizontally disposed end portion of a respective one of said lower and upper members of said movable frame, and (v) whereby said movable frame and said second plurality of elongated display sign elements are movable between a first position wherein said second plurality of elongated display sign elements are interposed with said first plurality of elongated display sign elements in a side-by-side arrangement to simultaneously display a pair of distinct views and a second position wherein said second plurality of elongated display sign elements are laterally spaced from said first plurality of elongated display sign elements.

15. A multi-sided display sign apparatus comprising:

(a) a stationary frame including:

(i) a bottom U-shaped member, (ii) a top U-shaped member, (iii) a pair of U-shaped side members, (iv) a first flange extending inwardly and horizontally from a front vertical leg of said bottom u-shaped member, (v) a predetermined plurality of first apertures formed through said first flange of said U-shaped bottom member in spaced relationship with each other, (vi) a predetermined plurality of first notches formed through said first flange of said U-shaped bottom member, each of said predetermined plurality of notches disposed between a pair of adjacent first apertures, (vi) a second flange extending inwardly and horizontally from a front vertical leg of said top U-shaped member, said second flange of said top member disposed parallel with said first flange of said bottom member, (vii) a predetermined plurality of second apertures formed through said second flange in spaced relationship with each other and in vertical alignment with predetermined plurality of first apertures, and (viii) a predetermined plurality of second notches formed through said second flange, each of said predetermined plurality of second notches disposed between a pair of adjacent second apertures in vertical alignment with a respective first notch of said bottom member;

(b) a first plurality of elongated display sign elements mounted in a spaced relationship within said stationary frame, wherein a longitudinal axis of each of said first plurality of elongated display sign elements is aligned with a respective first and second apertures;

(c) a first means for mounting each of said first plurality of elongated display sign elements for rotation about said longitudinal axis thereof;

(d) a first electrically operable drive means for rotating said first plurality of elongated display sign elements;

(e) a movable frame disposed internal add movable within said stationary frame, said movable frame including:

(i) a lower member having a predetermined plurality of first U-shaped sections, each of said predetermined plurality of first U-shaped sections extending in an upward direction and received within a respective first notch of said bottom member of said stationary frame;

(ii) an upper member having a predetermined plurality of second U-shaped sections extending in a downward direction, each of said predetermined plurality of second U-shaped is vertically aligned with a respective one of said predetermined plurality of first U-shaped sections and with a respective second notch of said top member of said stationary frame, (iii) a predetermined plurality of third apertures, each of said predetermined plurality of third apertures formed through a horizontal portion of a respective first U-shaped section, and (iv) a predetermined plurality of forth apertures, each of said predetermined plurality of forth apertures formed through a horizontal portion of a respective second U-shaped section in vertical alignment with a respective third aperture;

(f) a second plurality of elongated display sign elements mounted in a spaced relationship within said movable frame, wherein a longitudinal axis of each of said second plurality of elongated display sign elements is vertically aligned with a respective third and forth apertures;

(g) a second means for mounting each of said second plurality of elongated display sign elements for rotation about a longitudinal axis thereof;

(h) a second electrically operable drive means for rotating said second plurality of elongated display sign elements;

(i) a quartet of guide means, each of said quartet of guide means positioned adjacent a respective corner of each of said stationary and movable frames and having a portion thereof attached to said movable frame; and (j) a pair of drive assemblies, each of said pair of drive assemblies positioned mediate a respective vertical side of each of said stationary and movable frames and including:

(i) an electric motor having each of a first flange for rigid attachment to a predetermined portion of said stationary frame and a horizontally disposed output shaft, (ii) a horizontally disposed drive screw connected at one end thereof to said output shaft of said electric motor, (iii) a bearing mount for rotateably mounting an opposed end of said drive screw, said bearing mount having a second flange and at least one aperture formed therethrough, (iv) at least one drive nut mounted for reciprocal linear motion on said drive screw, said at least one drive nut having a third flange extending therefrom, said second third flange directly attached to a predetermined portion of said movable frame, and (v) whereby said movable frame and said second plurality of elongated display sign elements are movable between a first position wherein said second plurality of elongated display sign elements are interposed with said first plurality of elongated display sign elements in a side-by-side arrangement to simultaneously display a pair of distinct views and a second position wherein said second plurality of elongated display sign elements are laterally spaced from said first plurality of elongated display sign elements.

* * * * *